US011628988B2

(12) United States Patent
Richardson et al.

(10) Patent No.: US 11,628,988 B2
(45) Date of Patent: Apr. 18, 2023

(54) CHILD RESISTANT AIRTIGHT LID

(71) Applicant: 14TH ROUND INC., Los Angeles, CA (US)

(72) Inventors: Adam Kim Richardson, Los Angeles, CA (US); Christopher George Palmer, Los Angeles, CA (US); Lyle Livingston Guanzon, San Francisco, CA (US)

(73) Assignee: 14TH ROUND INC., Van Nuys, CA (US)

( * ) Notice: Subject to any disclaimer, the term of this patent is extended or adjusted under 35 U.S.C. 154(b) by 0 days.

(21) Appl. No.: 17/555,911

(22) Filed: Dec. 20, 2021

(65) Prior Publication Data

US 2022/0194671 A1 Jun. 23, 2022

Related U.S. Application Data

(60) Provisional application No. 63/128,069, filed on Dec. 19, 2020.

(51) Int. Cl.
*B65D 50/04* (2006.01)
*B65D 53/04* (2006.01)

(52) U.S. Cl.
CPC ..... *B65D 50/041* (2013.01); *B65D 53/04* (2013.01)

(58) Field of Classification Search
CPC .... B65D 50/041; B65D 53/04; B65D 50/043; B65D 50/04; B65D 53/02; B65D 41/023
See application file for complete search history.

(56) References Cited

U.S. PATENT DOCUMENTS

| | | | | |
|---|---|---|---|---|
| 1,997,203 | A | | 4/1935 | Shera |
| 2,444,119 | A | | 6/1948 | Thorn et al. |
| 3,430,798 | A | | 3/1969 | Goyet et al. |
| 3,811,174 | A | | 5/1974 | Eichinger |
| 3,923,192 | A | | 12/1975 | Walters |
| 3,987,929 | A | | 10/1976 | Mineo |
| 4,238,042 | A | | 12/1980 | Hatakeyama et al. |
| 4,238,092 | A | * | 12/1980 | Brennan ..... B64D 29/02 244/54 |
| 4,310,101 | A | | 1/1982 | Sekine |
| 4,782,969 | A | | 11/1988 | Henning |
| 4,936,474 | A | | 6/1990 | Szczesniak et al. |
| 5,000,332 | A | | 3/1991 | Whitacre |
| 5,133,471 | A | | 6/1992 | Pujol Almirall |
| 5,560,505 | A | | 10/1996 | Schneider et al. |
| 5,862,936 | A | | 1/1999 | Johanson |
| 5,984,123 | A | | 11/1999 | Mogami et al. |
| 7,568,585 | B2 | | 8/2009 | Baughman et al. |
| 8,870,037 | B2 | | 10/2014 | Takanohashi |
| 10,040,593 | B2 | | 8/2018 | Ross et al. |
| 10,059,490 | B2 | | 8/2018 | Schuetz |
| 10,150,599 | B2 | | 12/2018 | Julien et al. |
| 10,276,274 | B2 | | 4/2019 | Haepers et al. |

(Continued)

*Primary Examiner* — Shawn M Braden
(74) *Attorney, Agent, or Firm* — Flener IP & Business Law; Zareefa B. Flener; Ayhan E. Mertogul

(57) ABSTRACT

An airtight lid for a jar includes a sealing gasket that forms an airtight seal with the jar for the storage of aromatic or otherwise odoriferous contents within the jar. The airtight lid also includes and a child resistant opening mechanism that requires a simultaneous combination of a directed force and a torque to remove the lid from the jar.

20 Claims, 8 Drawing Sheets

(56) References Cited

U.S. PATENT DOCUMENTS

| | | | | |
|---|---|---|---|---|
| 2006/0255051 | A1* | 11/2006 | Adams | A47G 19/2272 220/770 |
| 2007/0062904 | A1 | 3/2007 | Beaudette | |
| 2007/0164031 | A1* | 7/2007 | Holz | G01F 23/48 220/300 |
| 2007/0199912 | A1* | 8/2007 | Libohova | B65D 50/041 215/220 |
| 2015/0210439 | A1* | 7/2015 | Kim | A45D 40/00 220/315 |
| 2018/0311108 | A1 | 11/2018 | Nappi | |
| 2019/0144175 | A1* | 5/2019 | Patton | B65D 50/04 215/252 |
| 2020/0148435 | A1* | 5/2020 | Brown | B65D 50/041 |
| 2020/0156139 | A1 | 5/2020 | Ross et al. | |
| 2020/0172292 | A1* | 6/2020 | Serrahima | B65D 25/02 |

* cited by examiner

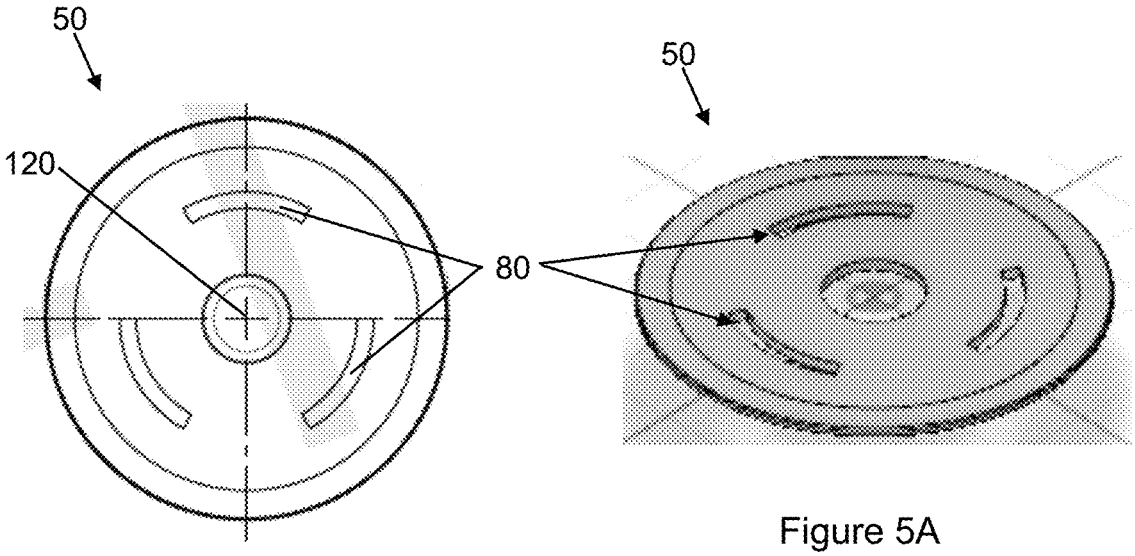
Figure 5B
Figure 5A
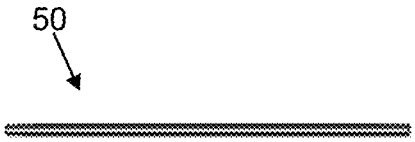
Figure 5C
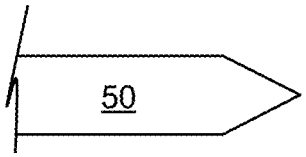
Figure 5D
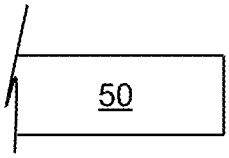
Figure 5E
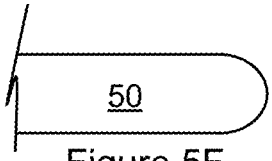
Figure 5F
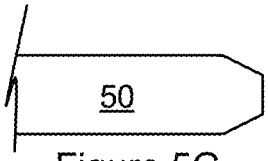
Figure 5G

CHILD RESISTANT AIRTIGHT LID

CROSS-REFERENCE TO RELATED APPLICATIONS

This application claims priority to U.S. Provisional application 63/128,069, filed on Dec. 19, 2020, the contents of which is incorporated by reference in its entirety herein.

FIELD OF THE INVENTION

The present invention relates to an airtight lid for a jar. More specifically, the present invention relates to an airtight lid for a jar that has a sealing gasket and a child resistant opening mechanism.

BACKGROUND

Storage jars for aromatic items are known in the art. Jars for medications and pills having a child resistant opening mechanism are also known in the art. However, what is needed is a jar having a lid that provides an airtight seal for the contents of the jar while also providing a child resistant opening mechanism. It would be advantageous for such a jar lid to be easily assembled from a minimum of parts, yet also durable and able to maintain an airtight seal over a long lifetime of use.

BRIEF DESCRIPTION OF THE DRAWINGS

FIG. 5A is a perspective view of a gasket component of an exemplary child resistant airtight lid;

FIG. 5B is a top plan view of the gasket component of FIG. 5A;

FIG. 5C is a side elevational view of the gasket of FIG. 5A;

FIG. 5D is an enlarged side elevational view of the gasket of FIG. 5A showing an exemplary edge configuration;

FIG. 5E is an enlarged side elevational view of the gasket of FIG. 5A showing another exemplary edge configuration;

FIG. 5F is an enlarged side elevational view of the gasket of FIG. 5A showing yet another exemplary edge configuration;

FIG. 5G is an enlarged side elevational view of the gasket of FIG. 5A showing a further exemplary edge configuration;

Other aspects and advantages of the present invention will become apparent upon consideration of the following detailed description, wherein similar structures have similar reference numerals.

DETAILED DESCRIPTION

The following detailed embodiments presented herein are for illustrative purposes. That is, these detailed embodiments are intended to be exemplary of the present invention for the purposes of providing and aiding a person skilled in the pertinent art to readily understand how to make and use of the present invention.

Figure 1:
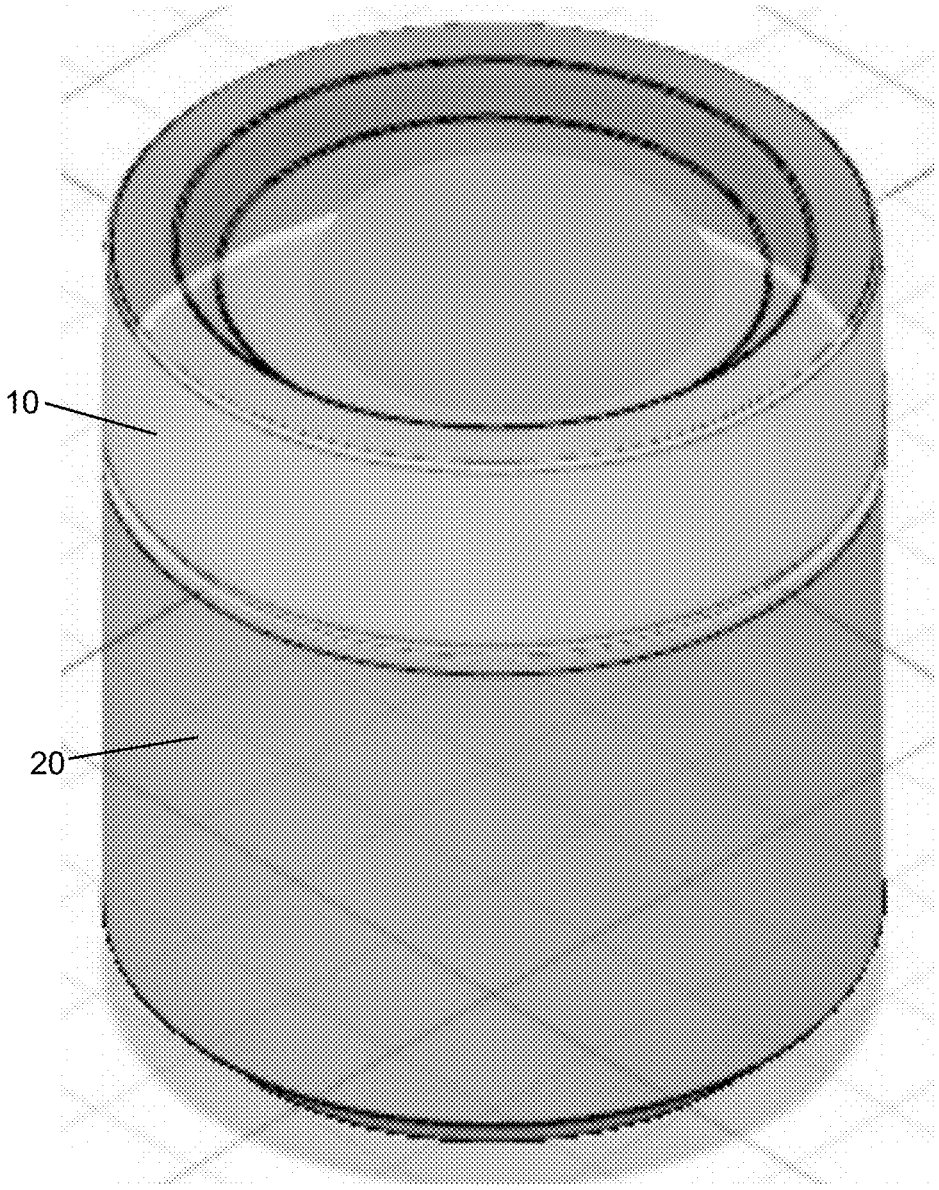
FIG. 1 is a perspective external view of an exemplary embodiment of a jar having a child resistant airtight lid.

Referring to FIG. 1, in one embodiment a child resistant airtight lid 10 is illustrated as assembled on a jar 20. The lid 10 in the illustrated embodiment has a concave top surface; however, in other embodiments the top surface of the lid 10 can be flat or convex and can be smooth and/or include any sort of surface decorations, indicia, recesses, or protrusions as may be desired to market the product to be stored within the jar 20 or otherwise as may be known in the art.

Figure 2:
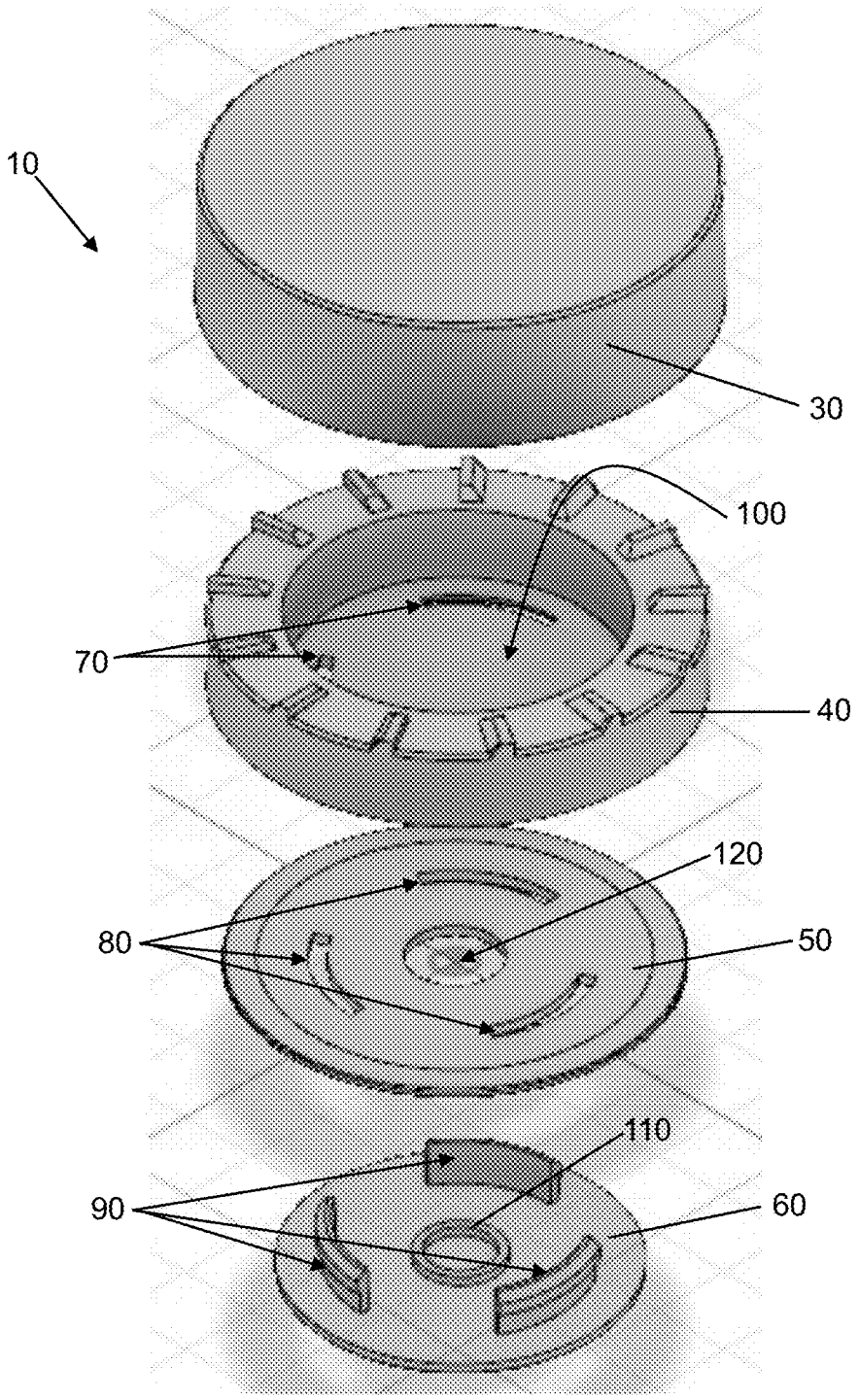
FIG. 2 is a perspective exploded view of the components of an exemplary child resistant airtight lid.

Referring to FIG. 2, the lid 10 is shown in an exploded view illustrating the four components thereof. As will be described in detail hereinbelow, an outer cap 30 having radially arranged internal ribs (not visible in FIG. 2) snaps over an outside of an inner cap 40, which has a first plurality of arcuate slots 70 disposed therethrough. A gasket 50 having a plurality of second arcuate slots 80 is affixed to a bottom of the inner cap 40 (as shown in FIG. 2) by a snap cap 60 having a plurality of radially flexible snap fingers 90 that extend through the first and second pluralities of arcuate slots 70, 80 and snap over an upward facing bottom surface 100 of the inner cap 40. In one embodiment the snap cap 60 further includes a central protruding structure 110, in this example an annular ring 110, that fits within a central circular aperture 120 in the gasket 50 to limit lateral motion of the gasket 50 relative to either the snap cap 60 or the inner cap 40.

Referring to FIGS. 3A-3D, the outer cap 30 includes a wall 130 and a skirt 140 that extends from a periphery of the wall 130. An arrangement of a plurality of radially oriented elongate protrusions 150 is circumferentially distributed on an inner surface 160 of the wall 130. As will be demonstrated hereinbelow the plurality of protrusions 150 are part of a child resistant opening mechanism. The outer cap 30 further includes a rib or protrusion 170 that extends radially inward from an inner surface of the skirt 140. As will be further described below, the rib 170 snaps over an edge of the inner cap 40 during assembly of the lid 10 and retains the outer cap 30 on the inner cap 40. The outer cap 30 can be manufactured, for example without limitation, from typical plastic polymers using methods including injection molding, compression molding, and fabrication or from other suitable materials using other suitable methods as are known in the art.

Figure 4B:
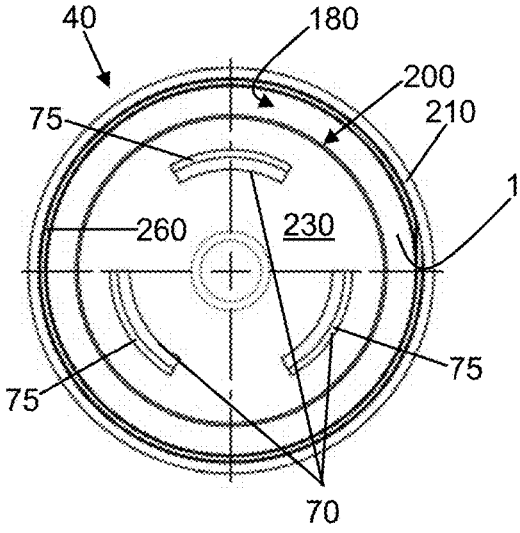
FIG. 4B is a bottom plan view of the inner cap component of FIG. 4A.
Figure 4A:
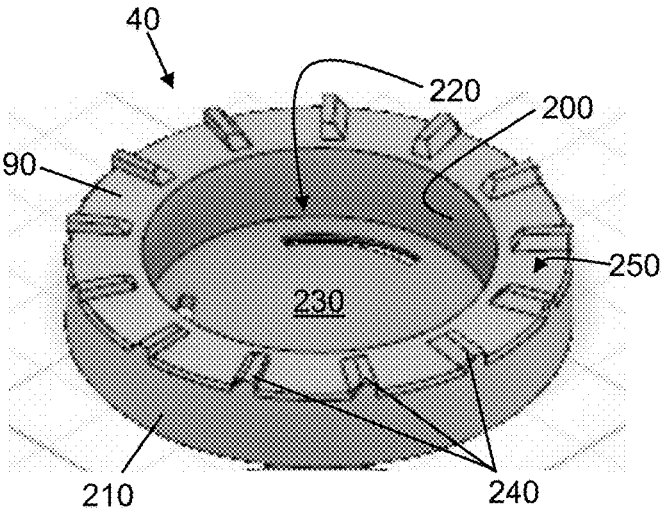
FIG. 4A is a perspective view of an inner cap component of an exemplary child resistant airtight lid.
Figure 4C:
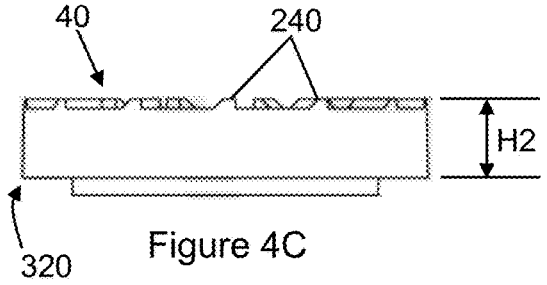
FIG. 4C is a side elevational view of the inner cap component of FIG. 4A.
Figure 4D:
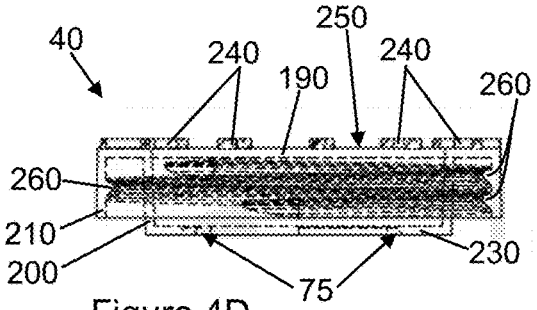
FIG. 4D is a side view of the inner cap component of FIG. 4A illustrating structure within as dashed lines.

Referring to FIGS. 4A-4D, the inner cap 40 includes an annular recess 180 defined by a base annular wall 190, and inner and outer skirts 200, 210 extending from the annular wall 190. A central recess 220 is defined by the inner skirt 200 and a central wall 230 attached at an end of the inner skirt 200 opposite from the annular wall 190. The annular recess 180 faces oppositely away from the central recess 220. The annular wall 190 includes an arrangement of a plurality of ramped elongate radially oriented protrusions 240 circumferentially distributed on a surface 250 of the annular wall 190 facing away from the annular recess 180. As shown in FIGS. 4A, 40, and 4D, in one embodiment each of the plurality of ramped elongate radially oriented protrusions 240 is squared on one circumferential facing edge but ramped on an opposite circumferential facing edge. The rationale for and directionality of the ramps will be further explained below in connection with the functionality of the child resistant opening mechanism.

The first plurality of arcuate slots 70 is best visible in FIG. 4B as disposed through the central wall 230. As visible in FIGS. 4B and 4D, each of the first plurality of arcuate slots 70 has a radially directed ramped outer radial edge 75. The ramped outer edges 75 cause each slot 70 to be larger at a side of the central wall 230 facing away from the protrusions 240 than at a side of the central wall 230 facing the same direction as the protrusions 240. The ramped outer edges 75 thereby assist in the assembly of the inner cap 40 with the snap cap 60 as will be further explained hereinbelow. Also visible in FIGS. 4B and 4D, the inner cap 40 includes a set of threads 260 that extend radially inward from the inner surface of the outer skirt 210. The inner cap 40 can be manufactured, for example without limitation, from typical plastic polymers using methods including injection molding, compression molding, and fabrication or from other suitable materials using other suitable methods as are known in the art.

Figure 6B:
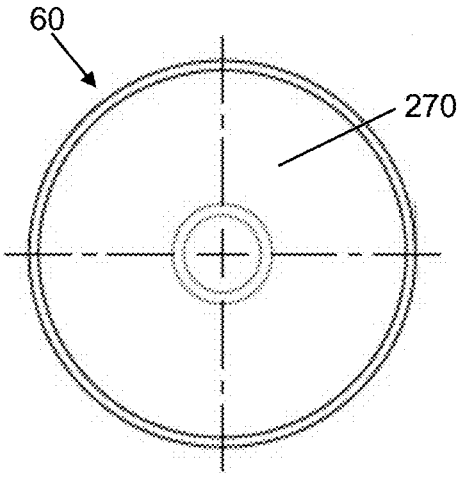
FIG. 6B is a bottom plan view of the snap cap component of FIG. 6A.
Figure 6A:
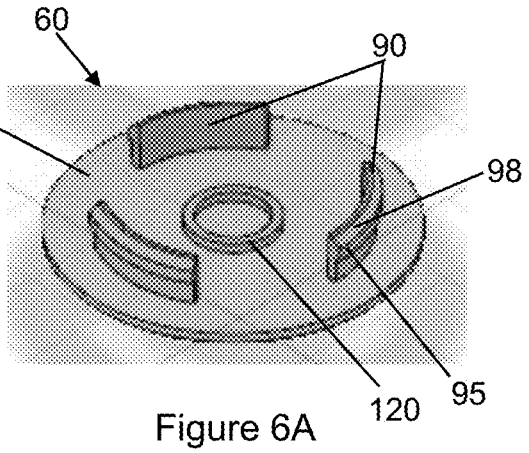
FIG. 6A is a perspective view of a snap cap component of an exemplary child resistant airtight lid.
Figure 6C:
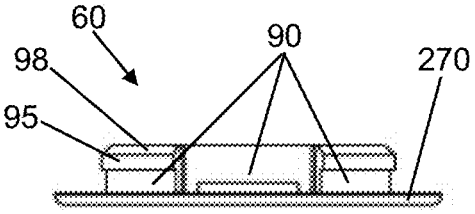
FIG. 6C is a side elevational view of the snap cap component of FIG. 6A.
Figure 6D:
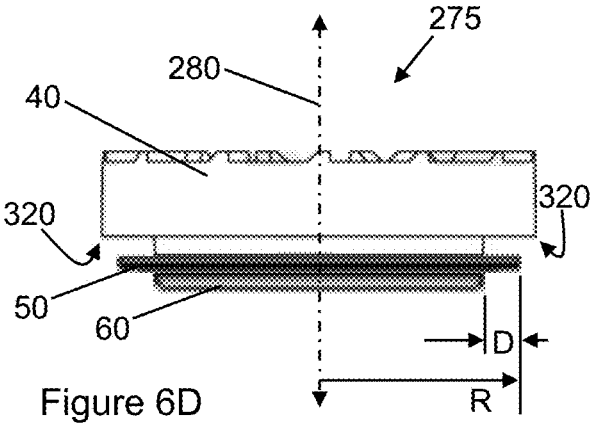
FIG. 6D is a side view of a sub-assembly of the exemplary child resistant airtight lid showing the gasket component fixed between the inner cap component and the snap cap component.

Referring to FIGS. 5A-5C, the gasket 50, in one embodiment is a sheet of compressible material sized to extend radially outwardly from the inner skirt 200 of the inner cap 40 (see FIG. 6D). The gasket 50 includes the second plurality of arcuate slots 80 and the central circular aperture 120 as best seen in FIG. 5B. The gasket 50 can be manufactured, for example without limitation, from typical plastic polymers using methods including injection molding, compression molding, and fabrication or from other suitable materials using other suitable methods as are known in the art. As shown in FIGS. 5D-5G in some embodiments an edge configuration of the gasket 50 is beveled at any one or two angles as desired to a sharp edge (FIG. 5D), whereas in other embodiments the edge configuration of the gasket 50 is squared off (FIG. 5E), rounded (FIG. 5F), or has a 3-sided edge (FIG. 5G). In still further embodiments not illustrated, the edge configuration of the gasket 50 can have a 4 or more sided edge, or any regular or irregular shape as may be desired or as otherwise known in the art.

Referring to FIGS. 6A-6C, the snap cap 60 includes a flat plate 270 from which the plurality of radially flexible snap fingers 90 and the central circular aperture 120 extend. Each of the plurality of snap fingers 90 includes a radially outwardly facing shoulder portion 95 on a free end thereof, and each of the shoulder portions 95 further includes a ramped end surface 98 (see FIGS. 6A and 6C). The snap cap 60 can be manufactured, for example without limitation, from typical plastic polymers using methods including injection molding, compression molding, and fabrication or from other suitable materials using other suitable methods as are known in the art.

Referring to FIG. 6D, a portion of the lid 10 has been assembled into a sub-assembly 275 that includes the inner cap 40, the gasket 50, and the snap cap 60. FIG. 6D is provided to not only show how the noted components appear when assembled but also to show that the edge of the gasket 50 when assembled between the snap cap 60 and the inner cap 40 extends radially beyond both by a distance indicated as D and from a center line 280 by a distance indicated as R.

Figure 7B:
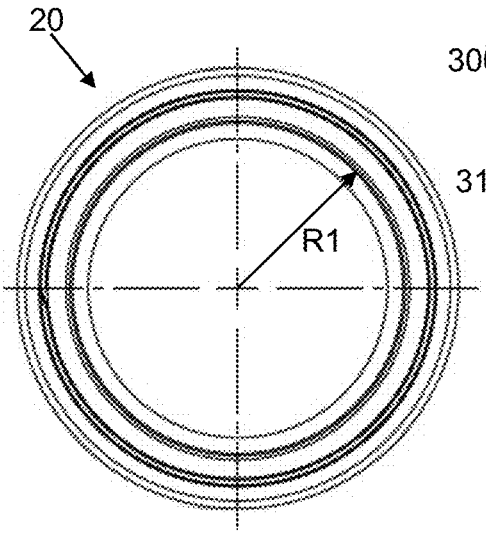
FIG. 7B is a top plan view of the exemplary jar of FIG. 7A.
Figure 7A:
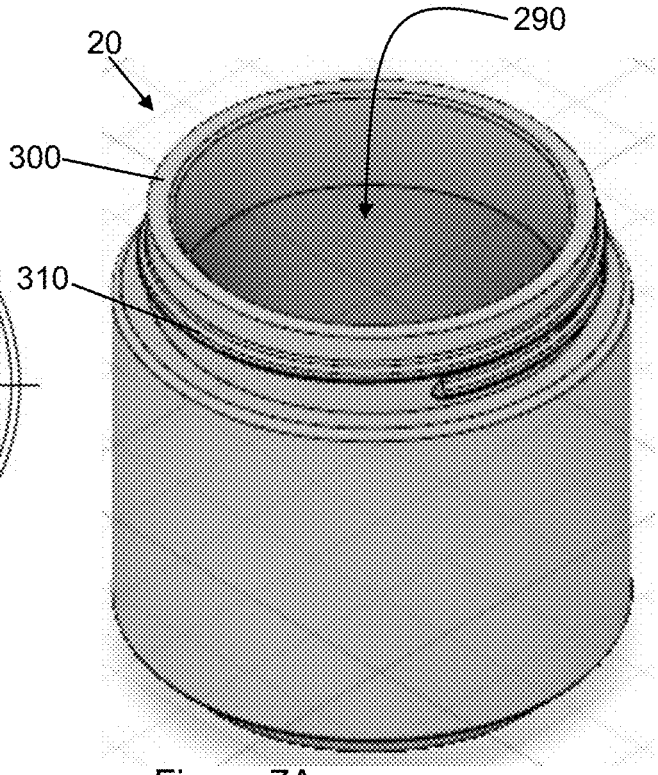
FIG. 7A is a perspective view of an exemplary jar for use with an exemplary child resistant airtight lid of the current invention.
Figure 7C:
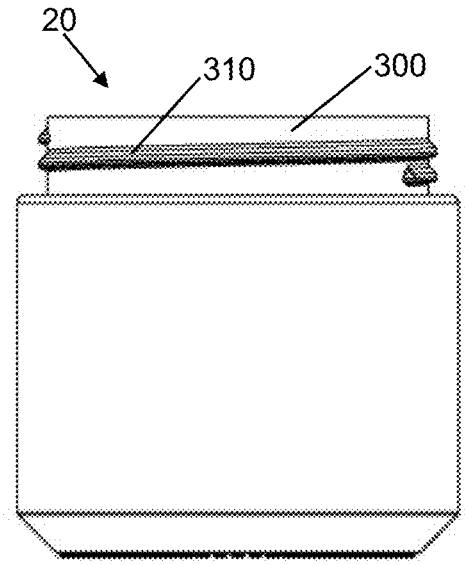
FIG. 7C is a side view of the exemplary jar of FIG. 7A.
Figure 7D:
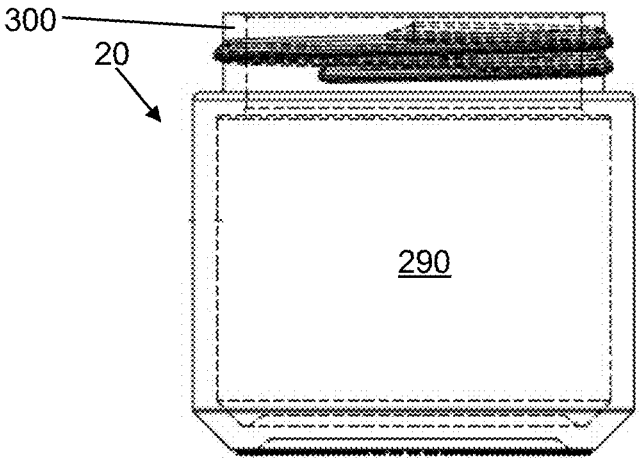
FIG. 7D is a side view of the exemplary jar of FIG. 7A illustrating structure within as dashed lines.

Referring to FIGS. 7A-7D, an exemplary jar 20 is illustrated. The exemplary jar shown in FIGS. 7A-7D is a generally round jar having an annularly supported concave base and an interior volume 290 having a correspondingly raised central bottom portion. However, the shape, external configuration, configuration of the interior volume, and/or material of the jar are not relevant to the operation of the lid 10 and may be any combination of shapes and configurations as desired for aesthetic or other reasons as may be known in the art. The jar 20 has a neck 300 having a set of threads 310 disposed on an outer surface thereof. The neck 300 has an interior radius R1 as shown in FIG. 7B.

Assembly of the lid 10 begins with a sub-assembly 275 of the gasket 50 between the snap cap 60 and the inner cap 40 as illustrated in FIG. 6D. To achieve the sub-assembly 275 the gasket 50 is placed against the central wall 230 of the inner cap 40 on a side facing the annular recess 180 with the first and second pluralities of arcuate slots 70, 80 lined up. The snap cap 60 is advanced toward the gasket 50 so that the plurality of radially flexible snap fingers 90 passes through the second plurality of arcuate slots 80. Further advancement of the snap cap 60 toward the inner cap 40 causes the ramped surfaces 98 at the free ends of the plurality of radially flexible snap fingers 90 to contact the ramped outer edges 75 of the first plurality of arcuate slots 70. Continued application of force on the snap cap 60 toward the inner cap 40 causes the ramped surfaces 98 of the shoulder portions 95 to ride up the ramped outer edges 75 causing the plurality of radially flexible snap fingers 90 to elastically flex radially inwardly, which creates a radially outward elastic bias in the plurality of radially flexible snap fingers 90. Further continued application of force on the snap cap 60 toward the inner cap 40 results in the shoulder portions 95 passing beyond the first plurality of arcuate slots 70 and snapping outwardly in response to the created radially outward elastic bias.

With the gasket 50 secured between the snap cap 60 and the inner cap 40 by the shoulder portions 95 being stuck behind the central wall 230, the sub-assembly 275 shown in FIG. 6D is ready to accept the outer cap 30. With the inner surface 160 of the wall 130 oriented toward the surface 250 of the annular wall 190 the outer cap 30 is advanced toward the inner cap 40. Further advancement of the outer cap 30 toward the inner cap 40 causes the rib or protrusion 170 to contact the outer surface of the skirt 210. Further advancement of the outer cap 30 over the inner cap 40 causes the rib or protrusion 170 to snap over a shoulder 320 (see FIG. 6D) on the inner cap 40. In an embodiment the rib or protrusion 170 is one continuous structure, but in other embodiments the rib or protrusion 170 comprises a plurality of ribs or protrusions 170 distributed around the inner surface of the skirt 140 and separated by spaces therebetween.

Figure 3B:
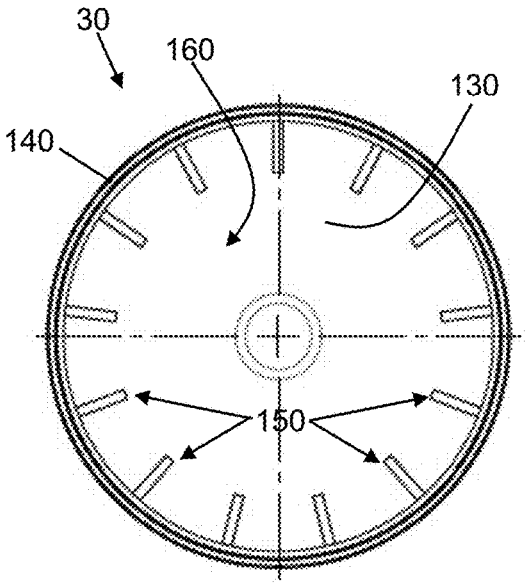
FIG. 3B is a bottom plan view of the outer cap component of FIG. 3A illustrating some structure within.
Figure 3A:
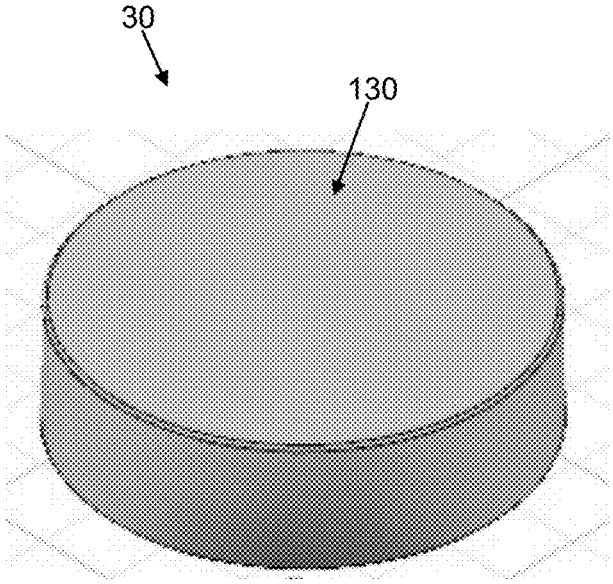
FIG. 3A is a perspective view of an outer cap component of an exemplary child resistant airtight lid.
Figure 3C:
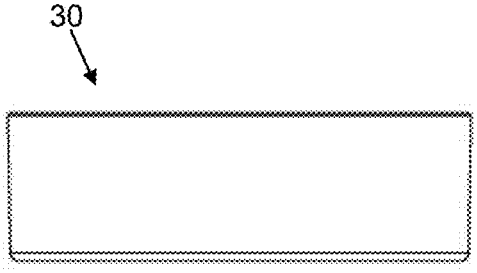
FIG. 3C is a side elevational view of the outer cap component (shown with open side up) of FIG. 3A'
Figure 3D:
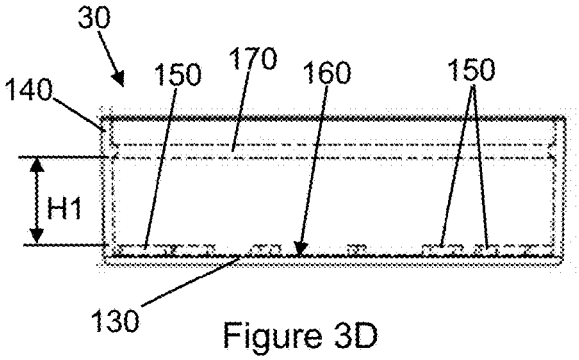
FIG. 3D is a side view of the outer cap component of FIG. 3A illustrating structure within as dashed lines.

The outer cap 30 is thus affixed to the inner cap 40. Referring to FIGS. 3D and 4C, dimension H1 on the outer cap 30 measured between an inner side of the rib 170 and the outward most surfaces of the plurality of protrusions 150 as shown in FIG. 3D is greater than dimension H2 on the inner cap 40 measured between the shoulder 320 and top most surfaces of the plurality of ramped elongate radially oriented protrusions 240. The difference in size between dimensions H1 and H2 allows the outer cap 30 to remain attached to the inner cap 40 while having two differently engaging geometries. In a first engaging geometry the outer cap 30 is positioned with the rib 170 close to or touching the shoulder 320 so that the outer cap 30 may freely rotate relative to the inner cap 40 without the plurality of protrusions 150 interfering with the plurality of protrusions 240. In a second engaging geometry the outer cap 30 is positioned with the plurality of protrusions 150 close to or touching the surface 250 on the inner cap 40. The child resistant opening mechanism is described with regard to this second engaging geometry.

Referring to FIGS. 4A, 4C, and 4D, in one embodiment the ramped elongate radially oriented protrusions 240 circumferentially distributed on the surface 250 of the annular wall 190 are arranged so that the ramped portion of each protrusion faces in a clockwise sense when viewed from above. The side of each protrusion facing in a counter-clockwise sense when viewed from above is a right angle. When the outer cap 30 is disposed in the second engaging geometry, the plurality of protrusions 150 is meshed between the plurality of protrusions 240, Any attempt to apply a torque to the outer cap 30 to turn the outer cap 30 clockwise relative to the inner cap 40 will engage the plurality of protrusions 150 with the flat walls presented by the right angled sides of the plurality of protrusions 240 and the inner cap 40 will turn with the outer cap 30. In this way threads 260 in the inner cap 40 can be engaged with threads 310 on the jar 20 to tighten the lid 10 onto the jar 20.

Once the lid 10 is tightened onto the jar 20, the above described geometry provides a child resistant opening mechanism as follows. Any attempt to apply a torque to the outer cap 30 turn the outer cap 30 counter-clockwise relative to the inner cap 40 will engage the plurality of protrusions 150 with the ramped sides of the plurality of protrusions 240. A force component of the applied torque directed along the ramps will overcome the static and dynamic friction between the plurality of protrusions 150 and the ramps of the plurality of protrusions 240 and drive the plurality of protrusions 150 up the ramps, which will cause the plurality of protrusions 150 and the outer cap 30 to ride up the ramps and not turn with the outer cap 30. In order to make the inner cap 40 turn counter-clockwise with the outer cap 30 to remove the lid 10, a downward force on the outer cap 30 toward the inner cap 40 must be applied while applying the torque to the outer cap 30. If the downward force on the outer cap 30 is sufficient to overcome a vertical component of the force component of the applied torque that is directed along the ramps of the plurality of protrusions 240, then the plurality of protrusions 150 will not ride up the ramps and the inner cap 40 will turn with the outer cap 30. The combination of a sufficient downward force and a torque applied to the outer cap 30 is what provides a child resistant opening mechanism for the lid 10.

Figure 8A:
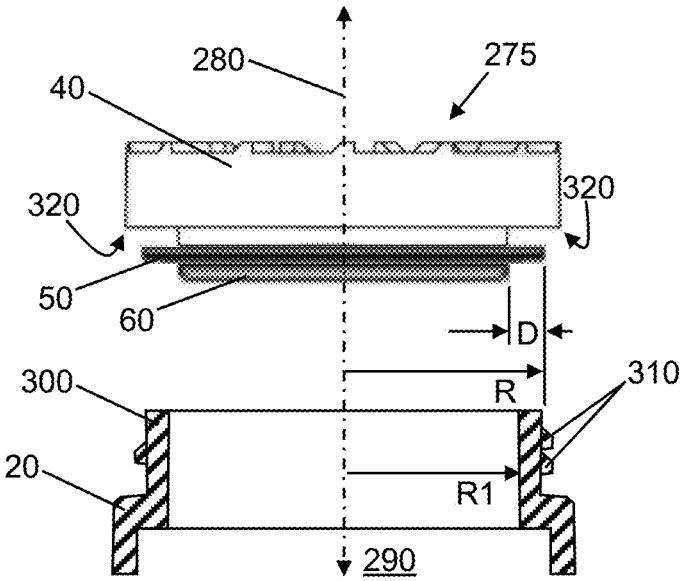
FIG. 8A is a side view of the sub-assembly of FIG. 6D shown in relation to the neck of an exemplary jar.
Figure 8B:
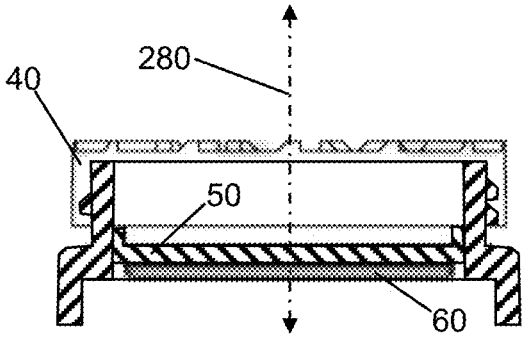
FIG. 8B is a side view of the sub-assembly of FIG. 6D shown as part of a lid applied to an exemplary jar.

Referring now to FIG. 8A, the sub-assembly 275 of FIG. 6D is shown in relationship to an exemplary jar 20. The distance that the gasket 50 extends from the centerline 280 is indicated as R. The jar 20 is indicated to have an inner radius in the neck 300 of R1. If R is greater than R1 then the gasket 50 will form a seal against the inner surface of the wall of the neck 300 when a lid 10 having the sub-assembly 275 is applied to the jar 20. The seal formed may be the result of radial compression, elastic bending, and or compression of a thickness of the gasket 50 that has been bent and is trapped between the inner cap 40 and the inner surface of the wall of the neck 300. For example, FIG. 8B illustrates an embodiment of the sub-assembly 275 installed on the jar 20 and shows the gasket 50 forming a seal by being bent and compressed by the inner surface of the wall of the neck 300.

INDUSTRIAL APPLICABILITY

An airtight lid for a jar has a sealing gasket and a child resistant opening mechanism. The lid can be manufactured by industry and used to store aromatic contents safely while inhibiting access thereto by children.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. An airtight lid, comprising:

an outer cap comprising a first wall and a first skirt depending from the first wall, wherein the first wall includes a protrusion extending radially inwardly from the first skirt;

an inner cap comprising an annular recess defined by a base annular wall and outer and inner skirts extending from the base annular wall, a central recess defined by the inner skirt and a central wall attached at an end of the inner skirt opposite from the base annular wall, the central wall comprising a first plurality of arcuate slots disposed therethrough;

a gasket comprising a sheet of compressible material having a second plurality of arcuate slots disposed therethrough; and a snap cap comprising a flat plate having a plurality of flexible snap fingers extending therefrom;

wherein a subassembly comprises the gasket secured between the inner cap and the snap cap by the plurality of flexible snap fingers disposed through the first and second pluralities of arcuate slots; and wherein the protrusion extending radially inwardly from the first skirt snaps over a shoulder on the outer skirt to attach the outer cap over the inner cap.

2. The airtight lid of claim 1, wherein the gasket further comprises a central circular aperture disposed therethrough and the snap cap further comprises a central protruding structure extending therefrom, wherein the central protruding structure is accommodated by the central circular aperture when the subassembly is assembled.

3. The airtight lid of claim 1, wherein a plurality of radially oriented elongate protrusions is circumferentially distributed on an inner surface of the first wall and a surface of the annular wall facing away from the annular recess includes an arrangement of a plurality of ramped elongate radially oriented protrusions circumferentially distributed thereon.

4. The airtight lid of claim 3, wherein the outer cap has a first height (H1) measured between an inner side of the protrusion extending radially inwardly from the first skirt and outward most surfaces of the plurality of radially oriented elongate protrusions, wherein the first height (H1) is greater than a second height (H2) measured on the inner cap between the shoulder on the outer skirt and top most surfaces of the plurality of ramped elongate radially oriented protrusions.

5. The airtight lid of claim 4, wherein the plurality of ramped elongate radially oriented protrusions is arranged so that the ramped portion of each protrusion faces in a clockwise sense when viewed from above, and wherein the side of each protrusion facing in a counter-clockwise sense when viewed from above is a right angle.

6. The airtight lid of claim 5, wherein the outer cap and the inner cap have first and second engaging geometries, wherein in a first engaging geometry the outer cap is positioned with the protrusion extending radially inwardly from the first skirt close to the shoulder on the outer skirt so that the outer cap freely rotates relative to the inner cap without the plurality of radially oriented elongate protrusions interfering with the plurality of ramped elongate radially oriented protrusions, and wherein in a second engaging geometry the outer cap is positioned with the plurality of radially oriented elongate protrusions close to or touching the surface of the annular wall facing away from the annular recess.

7. The airtight lid of claim 1, wherein an outer edge of the gasket when assembled in the subassembly between the snap cap and the inner cap extends radially beyond both of the snap cap and the inner cap.

8. The airtight lid of claim 1, wherein the outer edge of the gasket has a configuration selected from the group of configurations consisting of being beveled to a sharp edge, being squared off, being rounded, or having a three-sided edge.

9. The airtight lid of claim 1, wherein the inner cap further comprises a set of threads that extend radially inwardly from an inner surface of the outer skirt.

10. An airtight lid, comprising:

an outer cap comprising a first wall and a first skirt depending from the first wall, wherein the first wall includes a protrusion extending radially inwardly from the first skirt;

an inner cap comprising an annular recess defined by a base annular wall and outer and inner skirts extending from the base annular wall, a central recess defined by the inner skirt and a central wall attached at an end of the inner skirt opposite from the base annular wall, the central wall comprising a first plurality of arcuate slots disposed therethrough;

a gasket comprising a sheet of compressible material having a second plurality of arcuate slots disposed therethrough; and a snap cap comprising a flat plate having a plurality of flexible snap fingers extending therefrom;

wherein a subassembly comprises the gasket secured between the inner cap and the snap cap by the plurality of flexible snap fingers disposed through the first and second pluralities of arcuate slots, wherein an outer edge of the gasket when assembled in the subassembly between the snap cap and the inner cap extends radially beyond both of the snap cap and the inner cap; and wherein the protrusion extending radially inwardly from the first skirt snaps over a shoulder on the outer skirt to attach the outer cap over the inner cap.

11. The airtight lid of claim 10, wherein the gasket further comprises a central circular aperture disposed therethrough and the snap cap further comprises a central protruding structure extending therefrom, wherein the central protruding structure is accommodated by the central circular aperture when the subassembly is assembled.

12. The airtight lid of claim 10, wherein each of the first plurality of arcuate slots has a radially directed ramped outer radial edge so that each of the first plurality of arcuate slots is larger at a side of the central wall facing away from the central recess.

13. The airtight lid of claim 12, wherein each of the plurality of snap fingers includes a radially outwardly facing shoulder portion disposed on a free end thereof, and each of the shoulder portions further includes a ramped end surface.

14. The airtight lid of claim 10, wherein a plurality of radially oriented elongate protrusions is circumferentially distributed on an inner surface of the first wall and a surface of the annular wall facing away from the annular recess includes an arrangement of a plurality of ramped elongate radially oriented protrusions circumferentially distributed thereon.

15. The airtight lid of claim 14, wherein the outer cap has a first height (H1) measured between an inner side of the protrusion extending radially inwardly from the first skirt and outward most surfaces of the plurality of radially oriented elongate protrusions, wherein the first height (H1) is greater than a second height (H2) measured on the inner cap between the shoulder on the outer skirt and top most surfaces of the plurality of ramped elongate radially oriented protrusions.

16. The airtight lid of claim 15, wherein the plurality of ramped elongate radially oriented protrusions is arranged so that the ramped portion of each protrusion faces in a clockwise sense when viewed from above, and wherein the side of each protrusion facing in a counter-clockwise sense when viewed from above is a right angle.

17. An airtight lid, comprising:

an outer cap comprising a first wall and a first skirt depending from the first wall, wherein the first wall includes a protrusion extending radially inwardly from the first skirt;

an inner cap comprising an annular recess defined by a base annular wall and outer and inner skirts extending from the base annular wall, a central recess defined by the inner skirt and a central wall attached at an end of the inner skirt opposite from the base annular wall, the central wall comprising a first plurality of arcuate slots disposed therethrough;

a gasket comprising a sheet of compressible material having a second plurality of arcuate slots disposed therethrough; and a snap cap comprising a flat plate having a plurality of flexible snap fingers extending therefrom;

wherein a subassembly comprises the gasket secured between the inner cap and the snap cap by the plurality of flexible snap fingers disposed through the first and second pluralities of arcuate slots;

wherein the protrusion extending radially inwardly from the first skirt snaps over a shoulder on the outer skirt to attach the outer cap over the inner cap; and wherein a plurality of radially oriented elongate protrusions is circumferentially distributed on an inner surface of the first wall and a surface of the annular wall facing away from the annular recess includes an arrangement of a plurality of ramped elongate radially oriented protrusions circumferentially distributed thereon.

18. The airtight lid of claim 17, wherein the outer cap has a first height (H1) measured between an inner side of the protrusion extending radially inwardly from the first skirt and outward most surfaces of the plurality of radially oriented elongate protrusions, wherein the first height (H1) is greater than a second height (H2) measured on the inner cap between the shoulder on the outer skirt and top most surfaces of the plurality of ramped elongate radially oriented protrusions.

19. The airtight lid of claim 18, wherein the plurality of ramped elongate radially oriented protrusions is arranged so that the ramped portion of each protrusion faces in a clockwise sense when viewed from above, and wherein the side of each protrusion facing in a counter-clockwise sense when viewed from above is a right angle.

20. The airtight lid of claim 17, wherein an outer edge of the gasket when assembled in the subassembly between the snap cap and the inner cap extends radially beyond both of the snap cap and the inner cap.

* * * * *